US011817647B2

(12) United States Patent
Liao

(10) Patent No.: US 11,817,647 B2
(45) Date of Patent: Nov. 14, 2023

(54) ELECTRICAL CONNECTOR

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Fang-Jwu Liao, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 2 days.

(21) Appl. No.: 17/563,368

(22) Filed: Dec. 28, 2021

(65) Prior Publication Data

US 2022/0216634 A1 Jul. 7, 2022

Related U.S. Application Data

(60) Provisional application No. 63/133,348, filed on Jan. 2, 2021.

(51) Int. Cl.

| | |
|---|---|
| ***H01R 13/24*** | (2006.01) |
| ***H01R 12/57*** | (2011.01) |
| ***H01R 13/516*** | (2006.01) |
| ***H01R 13/40*** | (2006.01) |

(52) U.S. Cl.

CPC ..... *H01R 13/2407* (2013.01); *H01R 12/57* (2013.01); *H01R 13/40* (2013.01); *H01R 13/516* (2013.01)

(58) Field of Classification Search

CPC .... H01R 13/2407; H01R 12/57; H01R 13/40; H01R 13/516; H01R 12/7076; H01R 13/2442; H01R 13/41; H01R 13/11; H01R 12/716; H01R 13/639

See application file for complete search history.

(56) References Cited

U.S. PATENT DOCUMENTS

| | | | | |
|---|---|---|---|---|
| 6,749,440 | B1 * | 6/2004 | Szu | H01R 12/714 439/515 |
| 9,882,296 | B1 | 1/2018 | Ju | |
| 10,199,756 | B2 | 2/2019 | Ju et al. | |
| 10,535,946 | B2 | 1/2020 | Ho et al. | |
| 10,797,424 | B2 | 10/2020 | Hsu | |

(Continued)

*Primary Examiner* — Truc T Nguyen

(74) *Attorney, Agent, or Firm* — Ming Chieh Chang

(57) ABSTRACT

An electrical connector including: an insulative housing defining plural passageways and plural contacts disposed in corresponding passageways, the contact having a base extending in a first vertical plane and a resilient contacting arm upwardly and obliquely extending from an upper end of the base, the resilient contacting arm having a bulged contacting section at a free end thereof, a retaining section sidewardly linked to one side edge of the base to retain the contact within the passageway, and a supporting section sidewardly linked to another side edge of the base with an upwardly and obliquely curved abutting section at an upper end thereof, wherein the abutting section is adapted to be outwardly deflected when the contacting arm is downwardly deflected to sidewardly press the abutting section.

20 Claims, 27 Drawing Sheets

(56) References Cited

U.S. PATENT DOCUMENTS

| | | | | |
|---|---|---|---|---|
| 2009/0269950 | A1* | 10/2009 | Liao | H01R 13/2492 439/76.1 |
| 2017/0271801 | A1* | 9/2017 | Liao | H01R 13/631 |
| 2020/0176911 | A1* | 6/2020 | Hsu | H01R 12/725 |
| 2020/0303851 | A1* | 9/2020 | Hsu | H01R 13/2442 |
| 2020/0412037 | A1 | 12/2020 | Hsu | |
| 2023/0057208 | A1* | 2/2023 | O'Sullivan | A61N 5/0601 |

* cited by examiner

200

ELECTRICAL CONNECTOR

CROSS REFERENCE TO RELATED APPLICATIONS

This application claims the benefit of, and priority to, U.S. Provisional Patent Application No. 63/133,348, filed Jan. 2, 2021, the content of which is incorporated entirely herein by reference.

BACKGROUND OF THE INVENTION

1. Field of the Invention

The present invention relates to an electrical connector for use with a CPU (Central Processing Unit) or electronic package, and particularly to the electrical contact of the electrical connector having an angled resilient support side arm to sidewardly contact the primary resilient contacting arm.

2. Description of Related Arts

U.S. Pat. No. 6,019,611 discloses an electrical connector with a plurality of contacts. Each contact has a stationary planar/flat body with a bottom end connected to a printed circuit board (PCB), and a resilient contacting arm located beside and sidewardly contacting the planar main body with an upward contacting section upward abutting against a conductive pad of the CPU, thus resulting in a dual-path transmission between the conductive pad of the CPU and the PCB when the contacting arm is downwardly deflected by the CPU. Anyhow, because the main body is flat and essentially immovable for retention consideration, the operational procedure of sideward contact between the flat body and the resilient contacting arm during downward deflection of the contacting arm may be relatively harsh disadvantageously.

Therefore, it is desired to provide an electrical connector with corresponding contacts with the dual-path transmission in a smooth manner.

SUMMARY OF THE INVENTION

To achieve the above object, an electrical connector includes an insulative housing with a plurality of passageways extending therethrough in a vertical direction. A plurality of contacts are disposed in the corresponding passageways, respectively. Each contact includes a base with a resilient contacting arm upwardly extending from an upper end of the base and equipped with a contacting section at a free end thereof. A retaining section is sidewardly linked to one side edge of the base. A supporting section is sidewardly linked to the other side edge of the base. In a top view, the supporting section is angled with regard to the base via an acute angle while the retaining section is angled with regard to the base via a right angle. An upwardly and upwardly curved abutting section is located at a top portion of the supporting section. The transitional line of curvilinear configuration of the abutting section is not horizontal but extending in a forwardly ad downwardly inclined manner for compliance with the downwardly deflected contacting arm. At least one of the base and supporting section forms a horizontal seat with a solder ball attached upon an underside thereof. A plurality of standoffs are formed upon an upper surface of the housing corresponding to each passageway. In a top view, the standoff and the supporting section are located by two opposite sides of the contacting arm in a transverse direction.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1A:
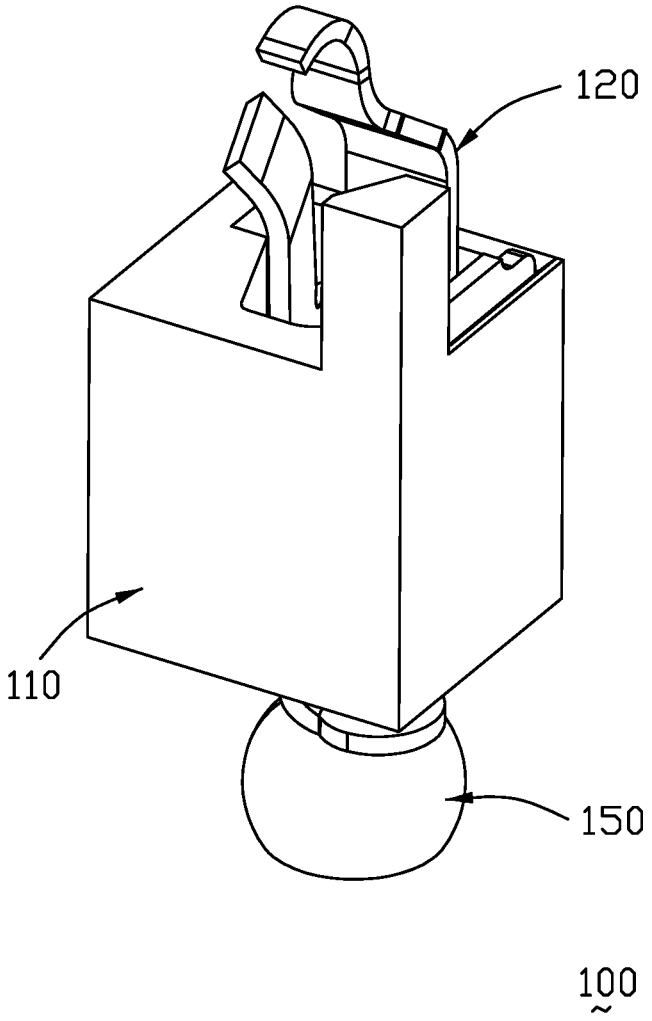
FIG. 1(A) is a perspective view of an electrical connector according to a first embodiment of the invention.
Figure 1B:
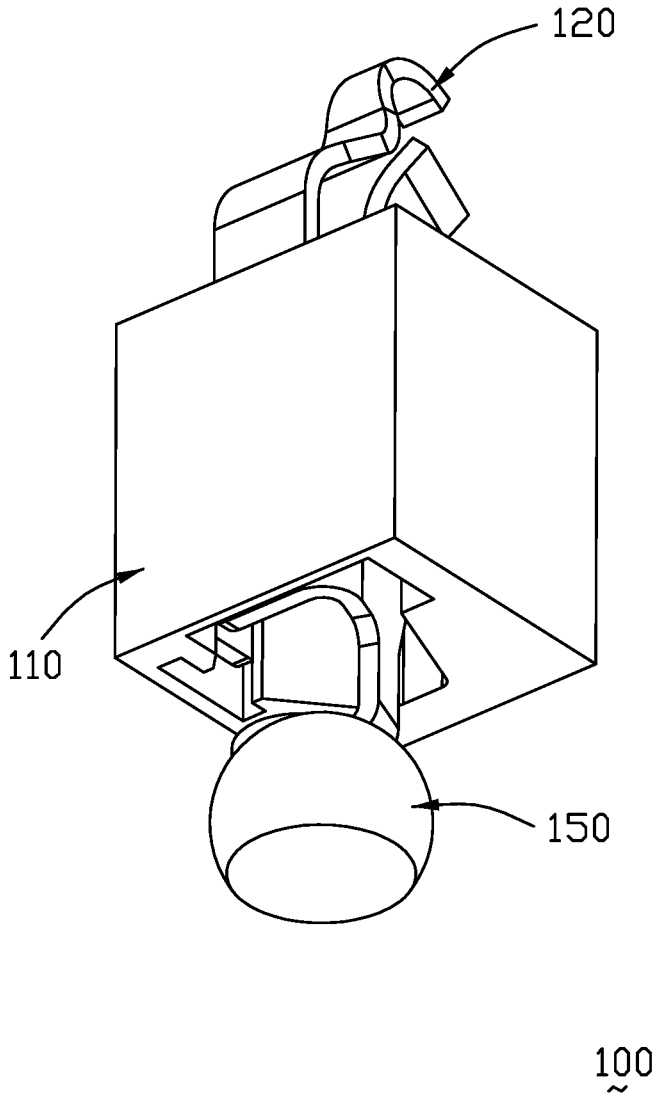
FIG. 1(B) is another perspective view of the electrical of FIG. 1(A)

Referring to FIGS. 1(A)-2(D) which show a first embodiment of this invention, an electrical connector 100 for receiving a CPU or electronic package, includes an insulative housing 110 forming a plurality of passageways 112 (only one shown) extending therethrough in a vertical direction. Each passageway 112 receives a contact 120 therein. The contact 120 includes a base 122 with a resilient contacting arm 124 extending upwardly and obliquely from an upper end of the base 122 and equipped with a bulged contacting section 126 at a free end thereof. A retaining section 140 is sidewardly linked to one side edge of the base 122 with a connection upper end 142 for linking to a contact carrier (not shown) so as to downwardly assemble the contact 120 into the corresponding passageway 112. A supporting section 130 is sidewardly linked to the other side edge of the base 122 with an outwardly and upwardly curved abutting section/head 132 at an upper end thereof and a solder pad 134 or horizontal seat at a lower end thereof. A solder ball 150 is attached on an underside of the solder pad 134 for mounting the solder pad to the PCB. The abutting section 132 is adapted to be outwardly deflected when the corresponding side edge of the downwardly deflected contacting arm 124 sidewardly pushes the abutting section 132, and then an electrical path shown as S1 from the contacting arm 124 to the supporting section 130 is formed.

Figure 1C:
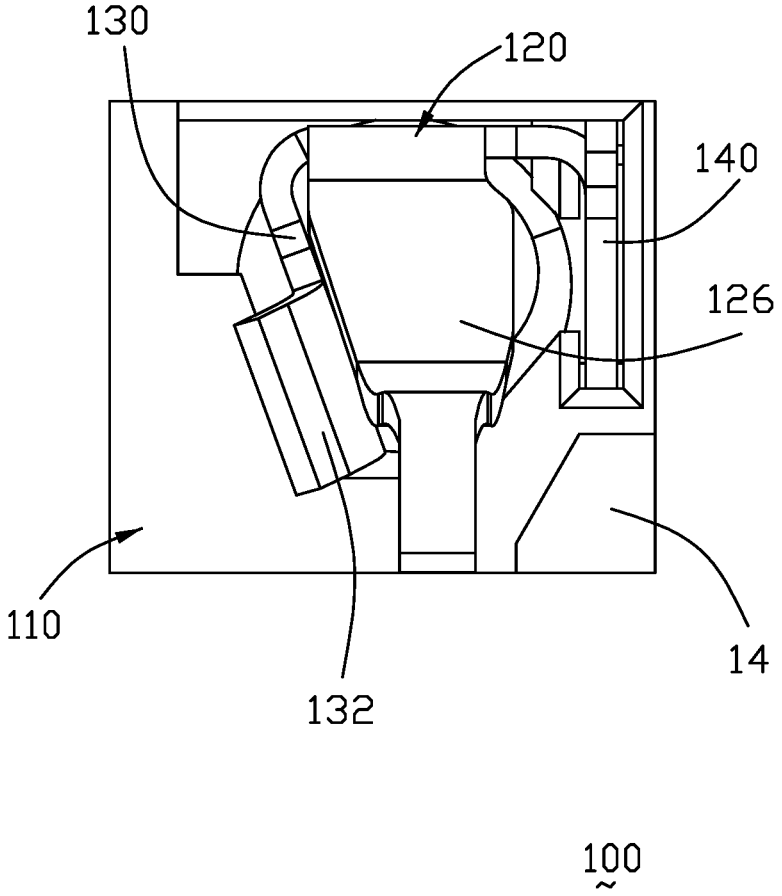
FIG. 1(C) is a top view of the electrical connector of FIG. 1(A)
Figure 1D:
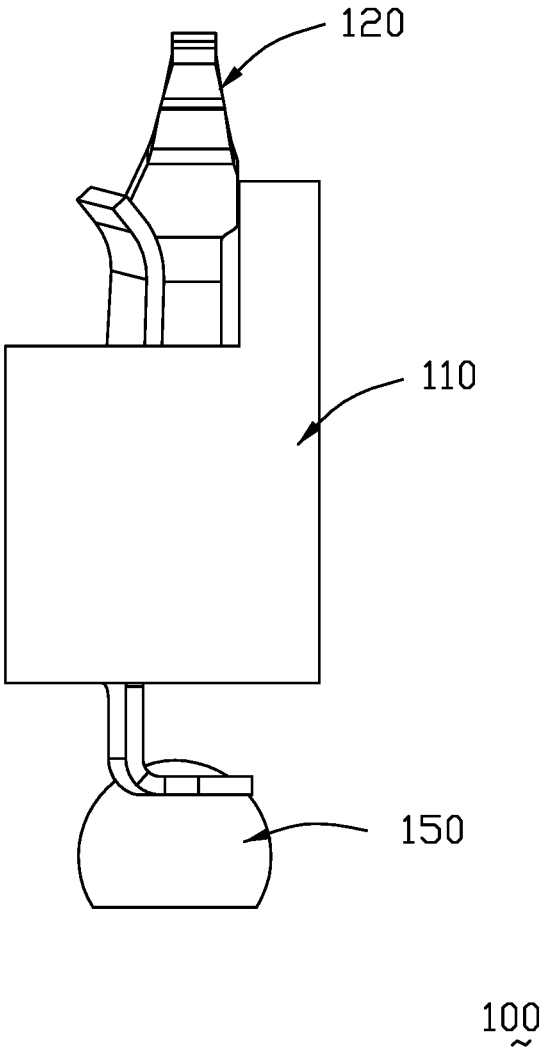
FIG. 1(D) is an elevational view of the electrical connector of FIG. (A) in a front-to-back direction.
Figure 1E:
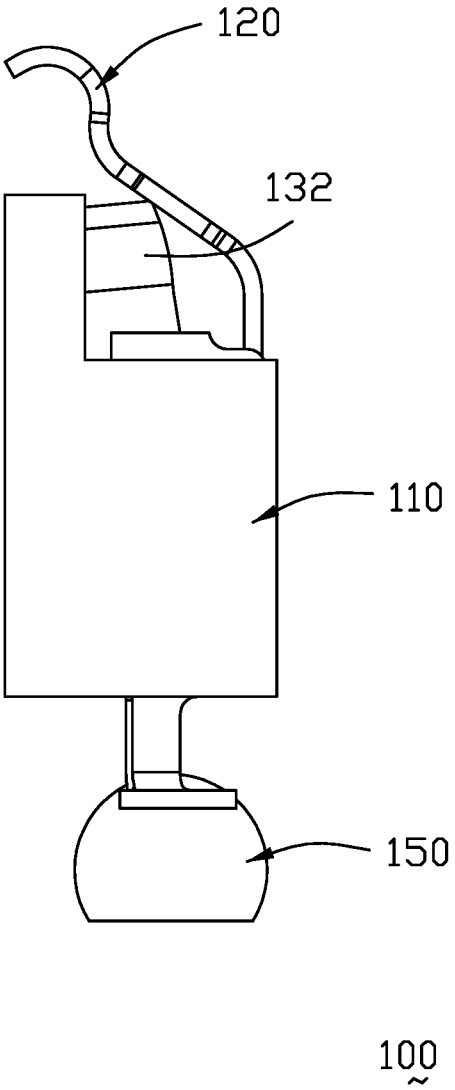
FIG. 1(E) is a side view of the electrical connector of FIG. 1(A) in a transverse direction.
Figure 2A:
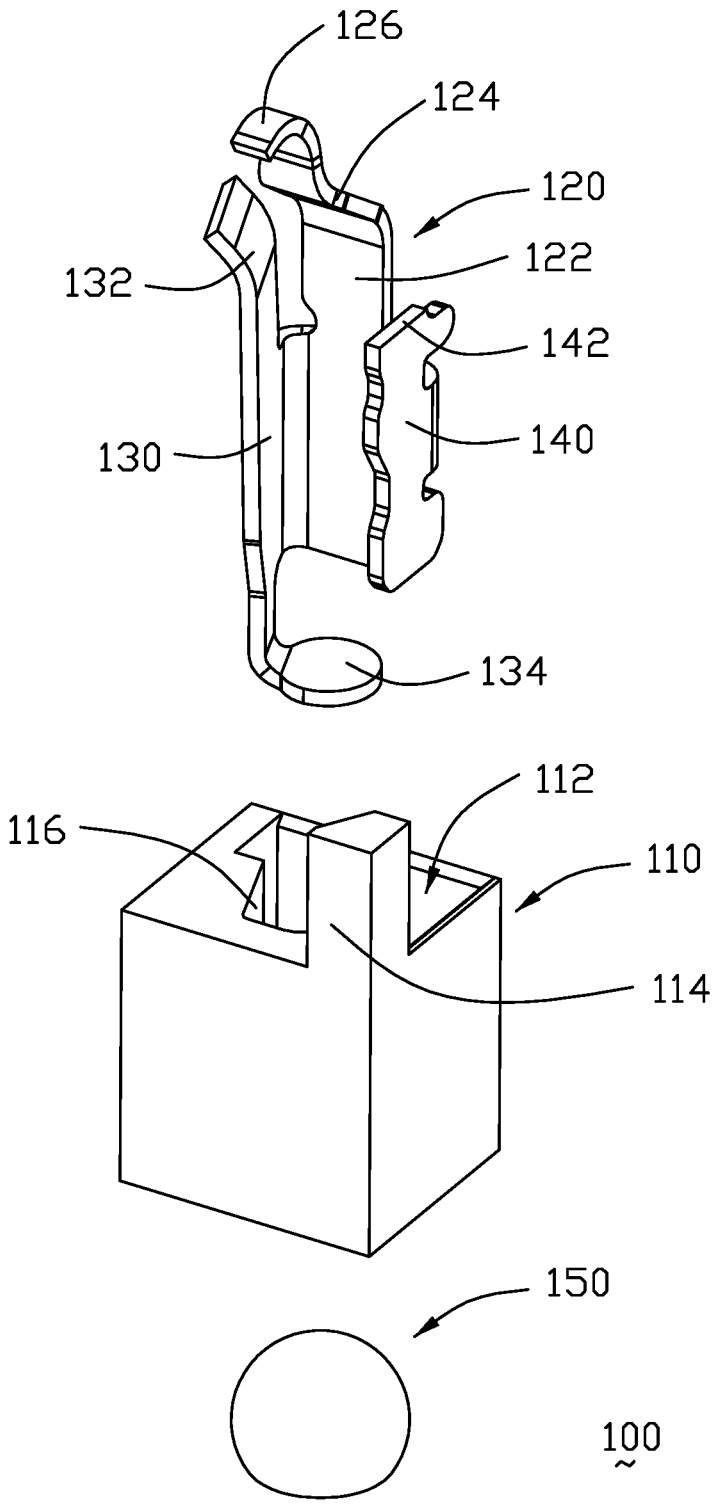
FIG. 2(A) is an exploded view of the electrical connector of FIG. 1(A)
Figure 2B:
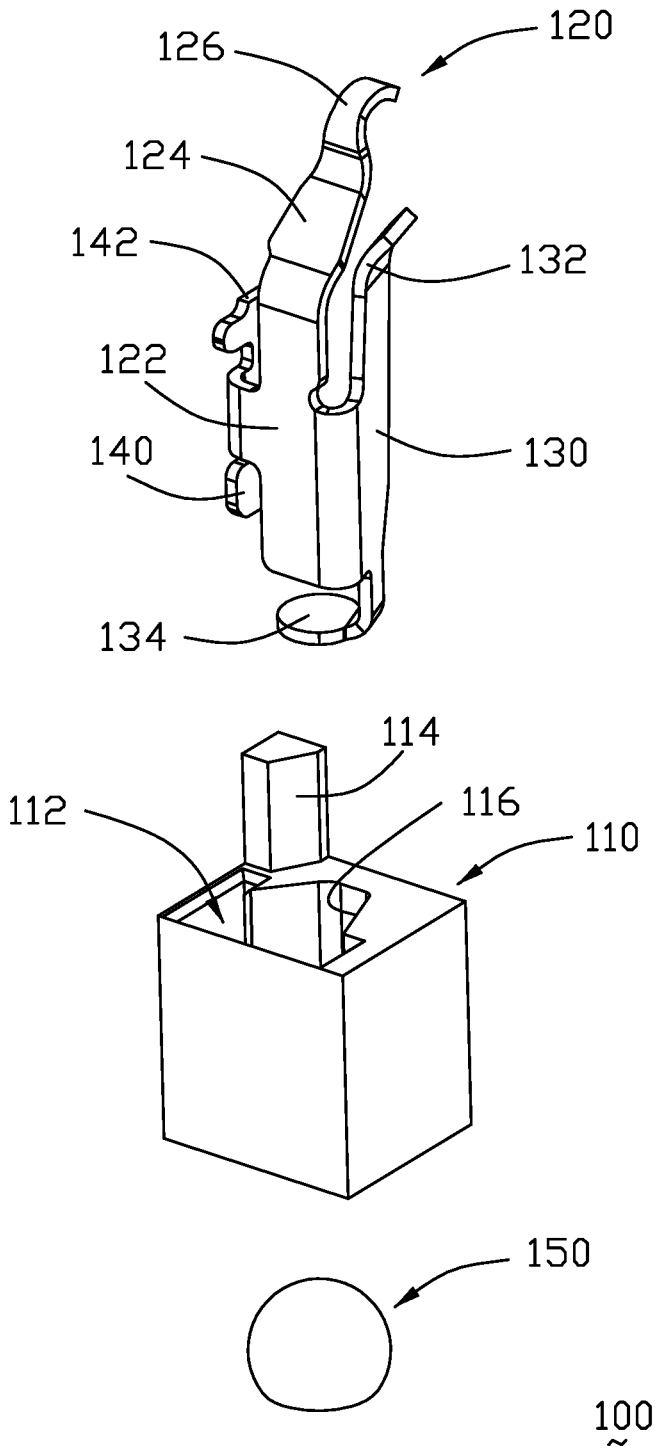
FIG. 2(B) is another exploded perspective view of the electrical connector of FIG. 2(A)
Figure 2C:
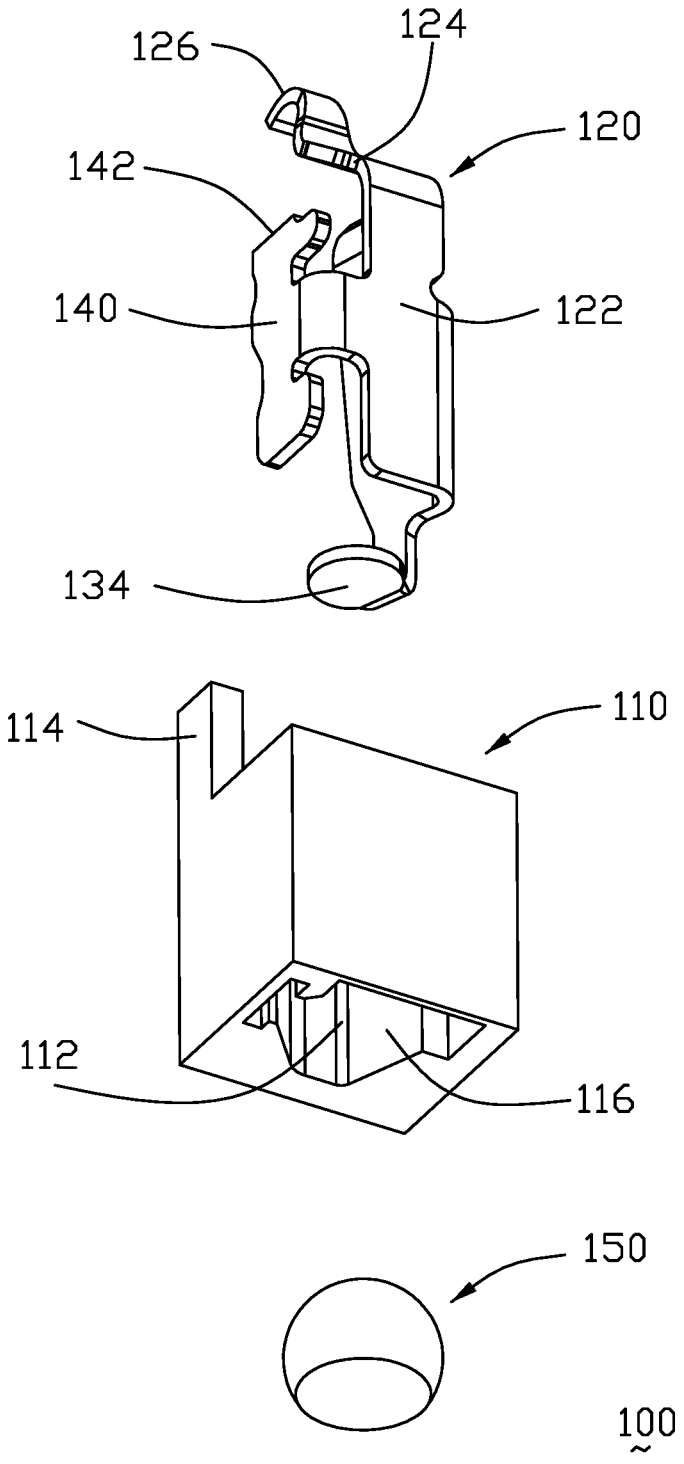
FIG. 2(C) is another exploded perspective view of the electrical connector of FIG. 2(A)
Figure 2D:
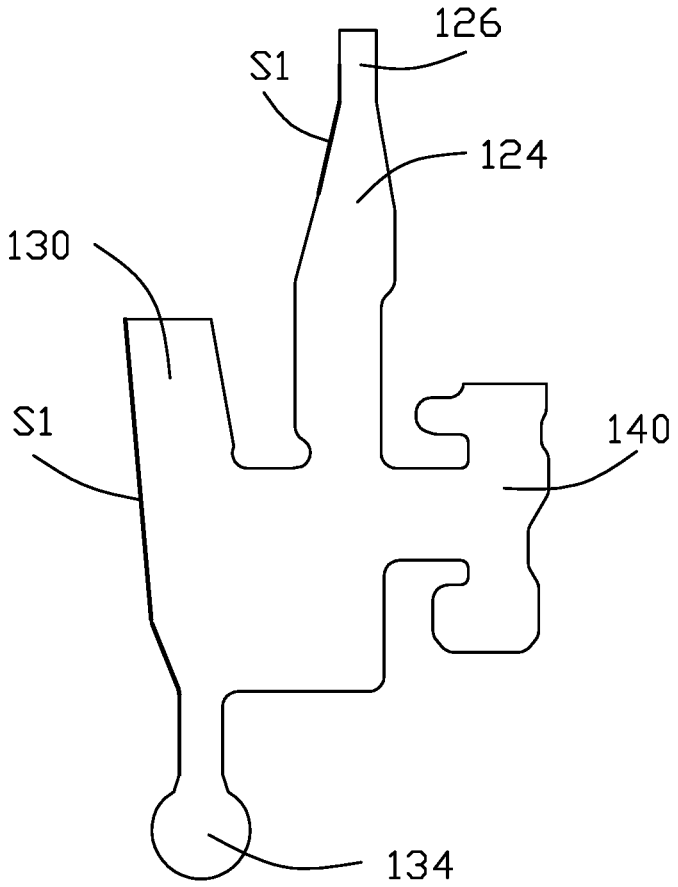
FIG. 2(D) is a perspective view of the unfolded contacts of the electrical connector of FIG. 2(A)
Figure 3A:
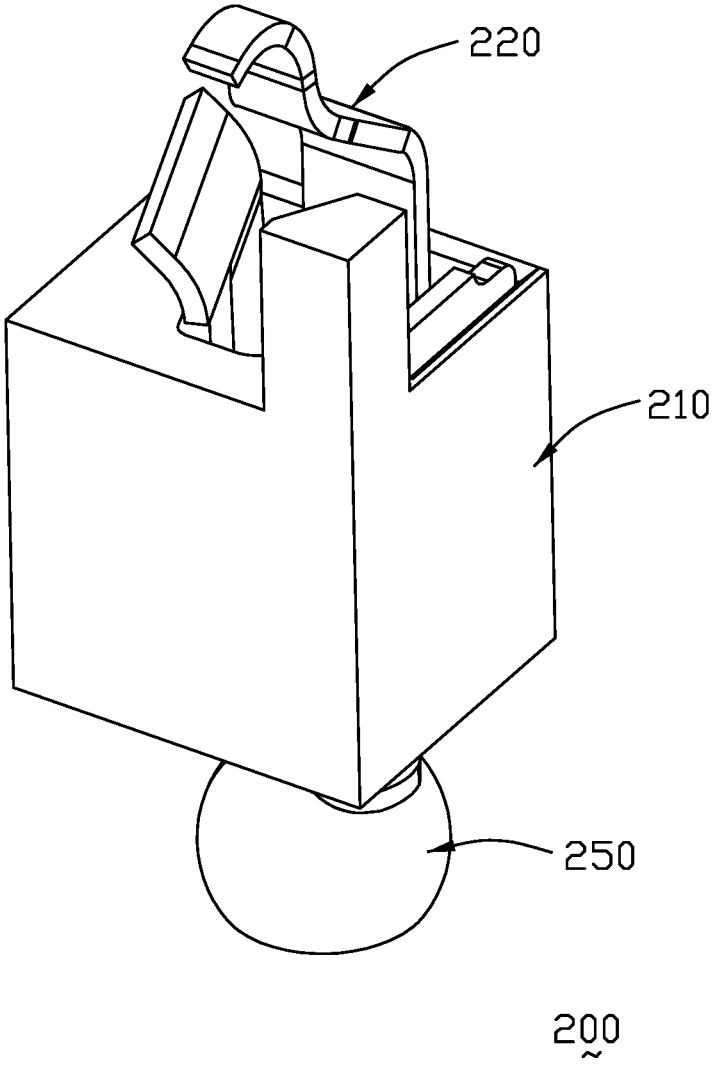
FIG. 3(A) is a perspective view of the electrical connector according to a second embodiment of the invention.
Figure 3B:
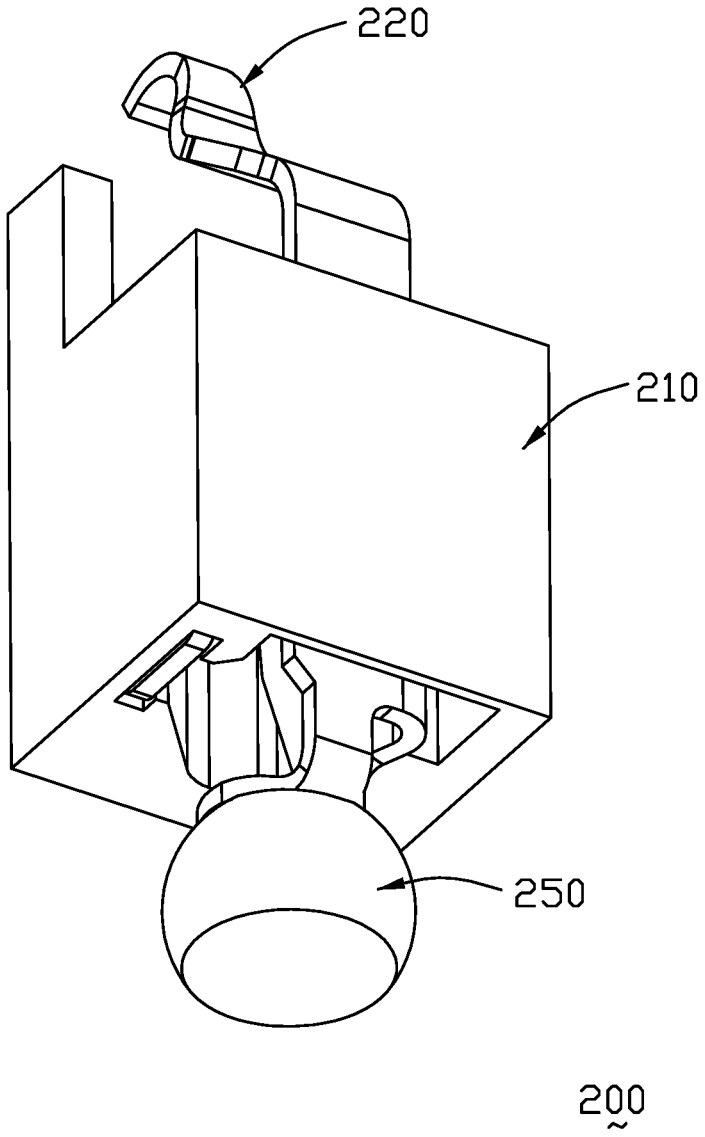
FIG. 3(B) is another perspective view of the electrical connector of FIG. 3(A)
Figure 3C:
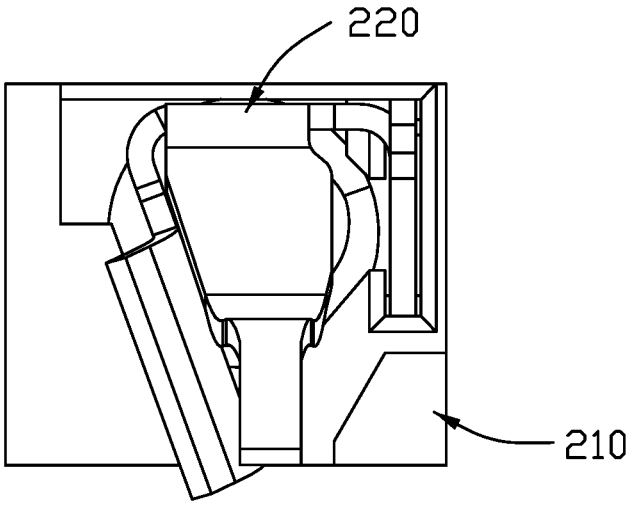
FIG. 3(C) is a top view of the electrical connector of FIG. 3(A)
Figure 3D:
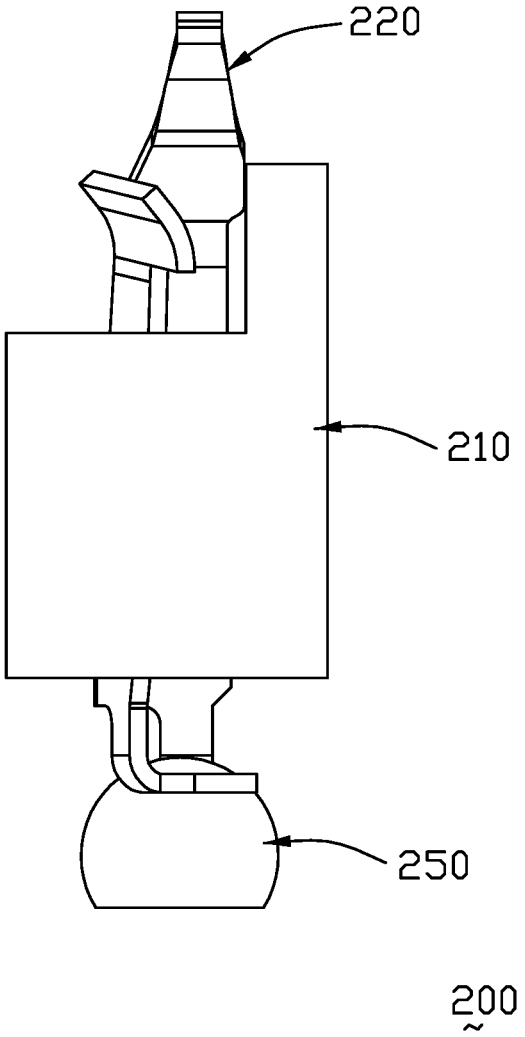
FIG. 3(D) is an elevational view of the electrical connector of FIG. 3(A) along a front-to-back direction.
Figure 3E:
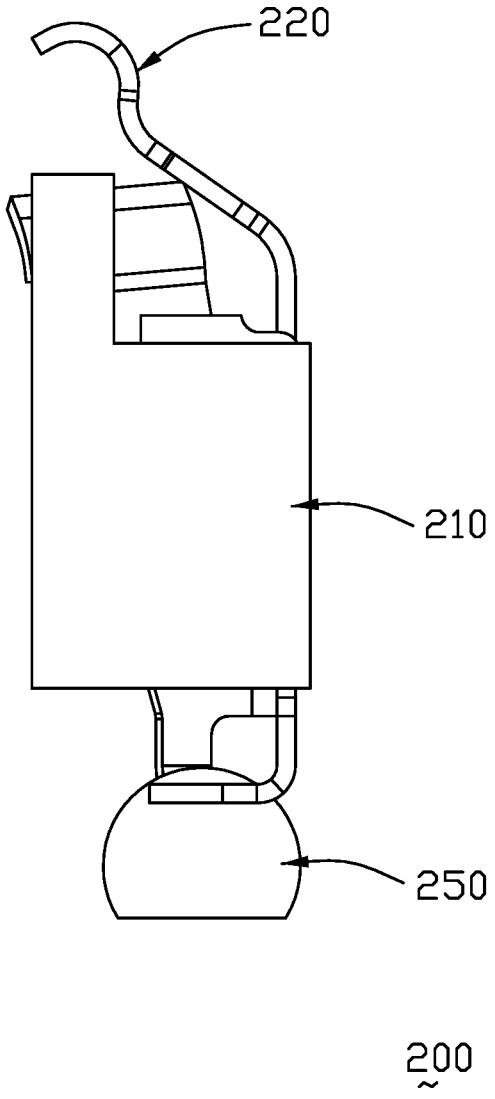
FIG. 3(E) is a side view of the electrical connector of FIG. 3(A) along a transverse direction.
Figure 4A:
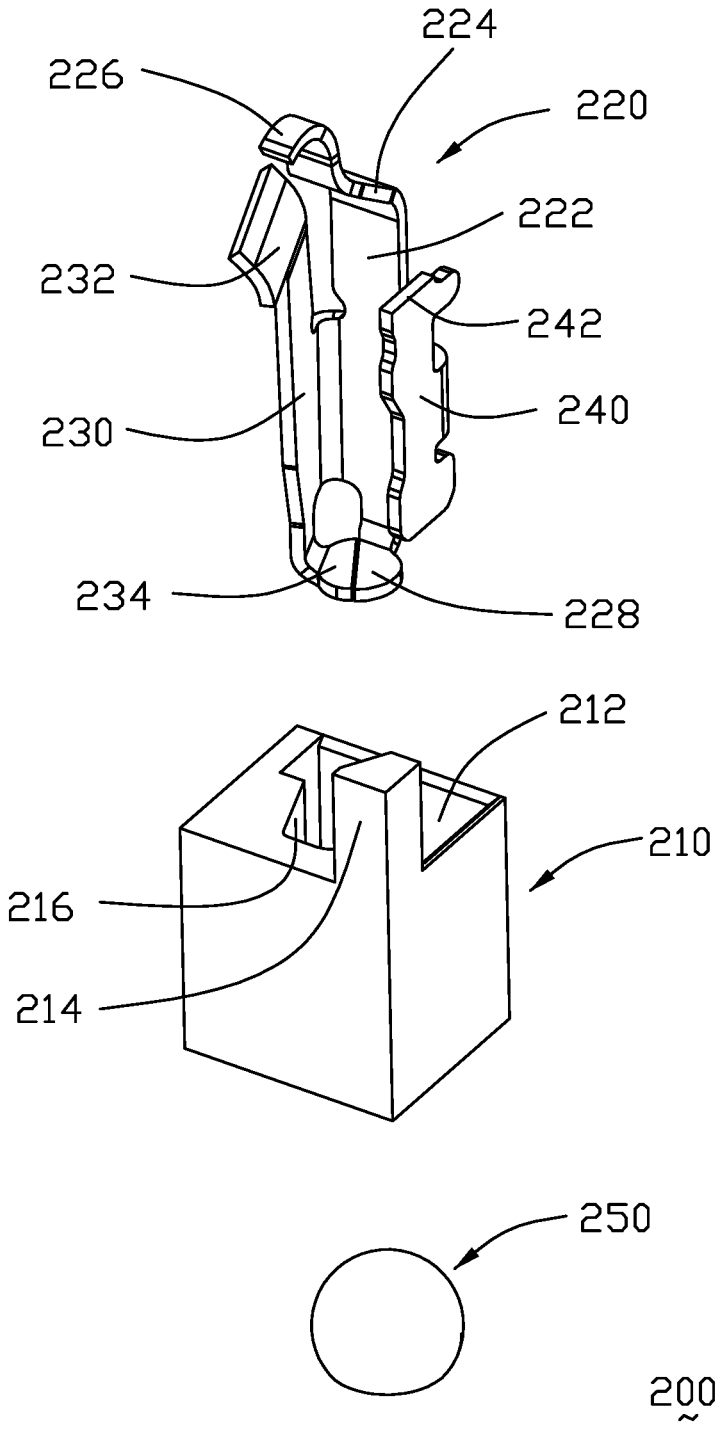
FIG. 4(A) is an exploded perspective view of the electrical connector of FIG. 3(A)
Figure 4B:
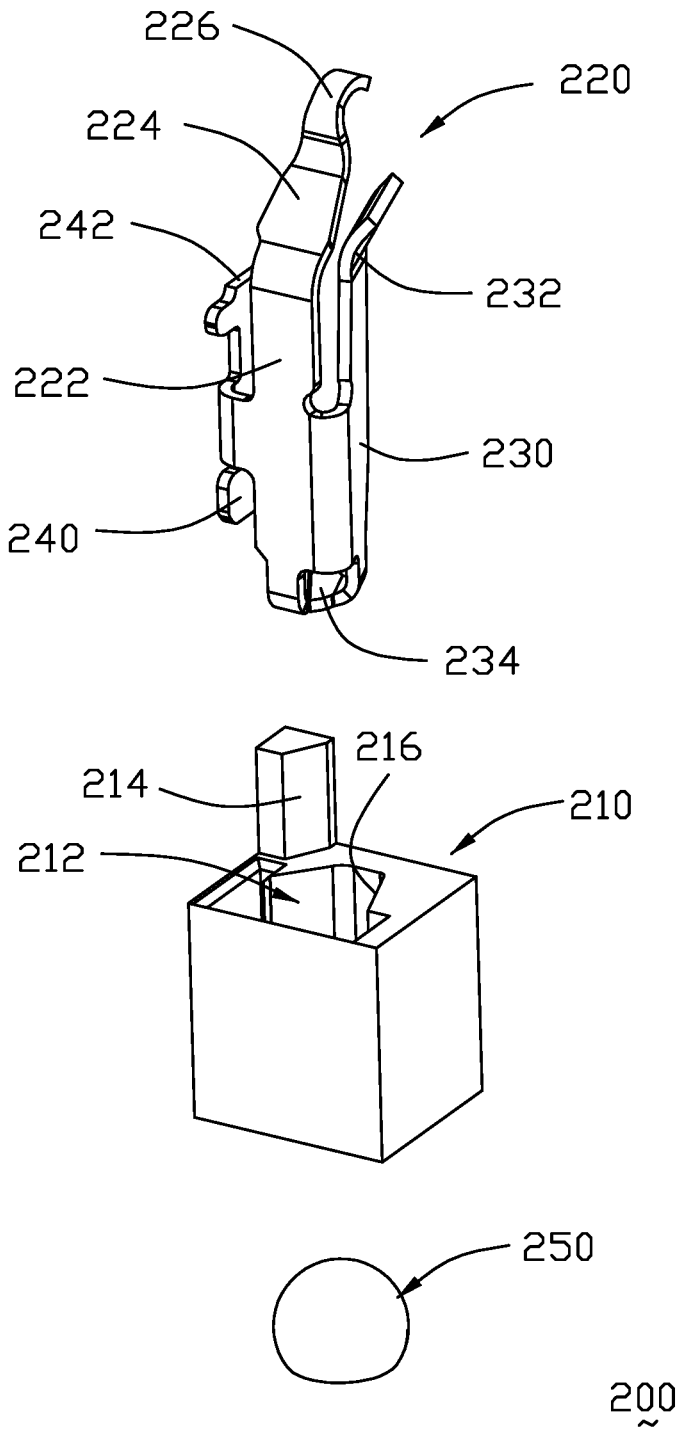
FIG. 4(B) is another exploded perspective view of the electrical connector of FIG. 4(A)
Figure 4C:
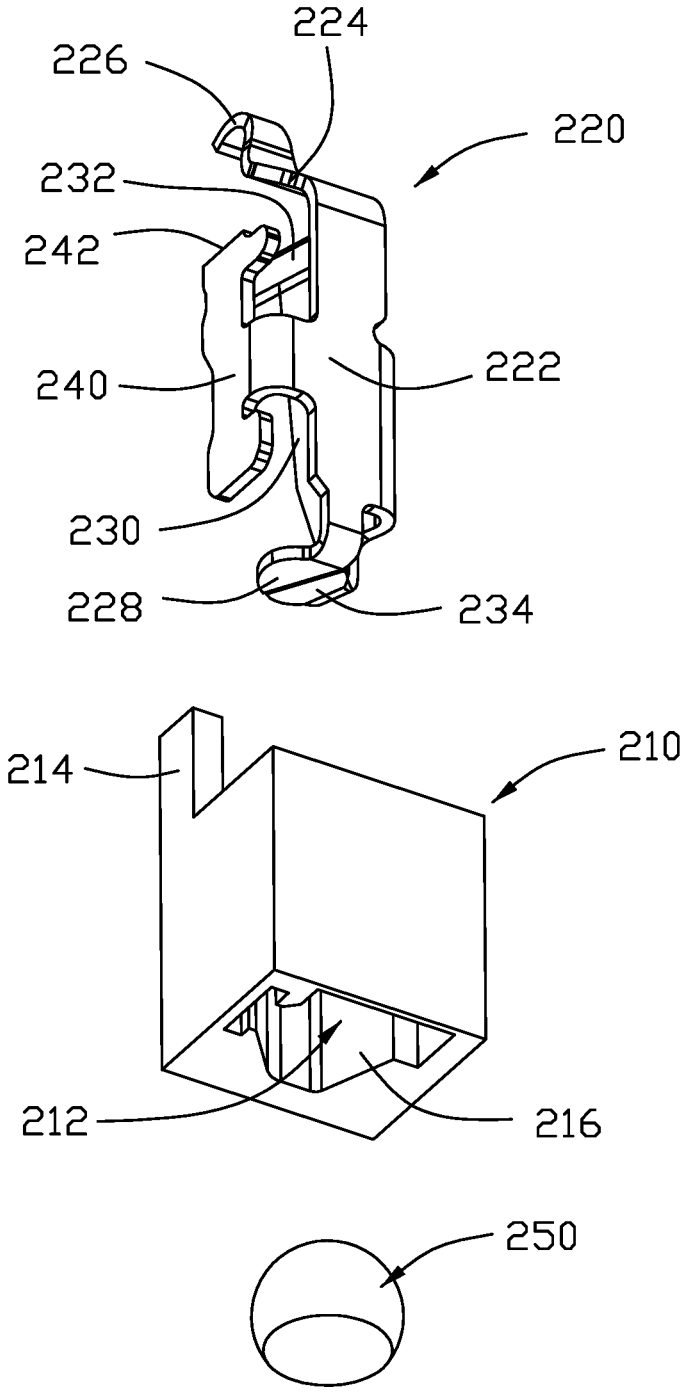
FIG. 4(C) is another exploded perspective view of the electrical connector of FIG. 4(A)
Figure 4D:
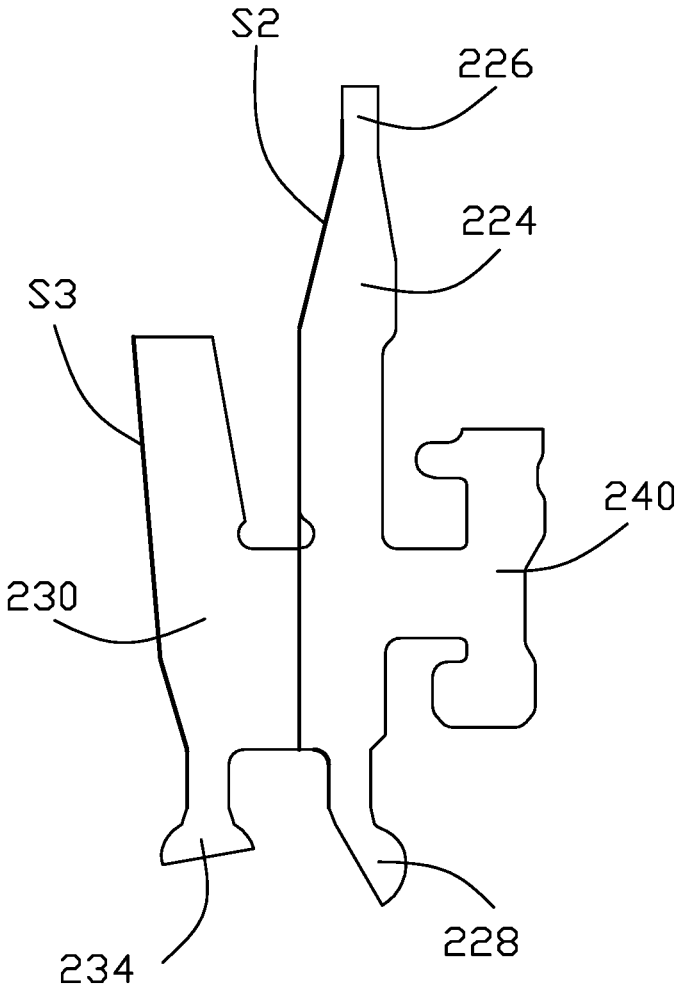
FIG. 4(D) is a perspective view of the unfolded contacts of the electrical connector of FIG. 4(A)
Figure 5A:
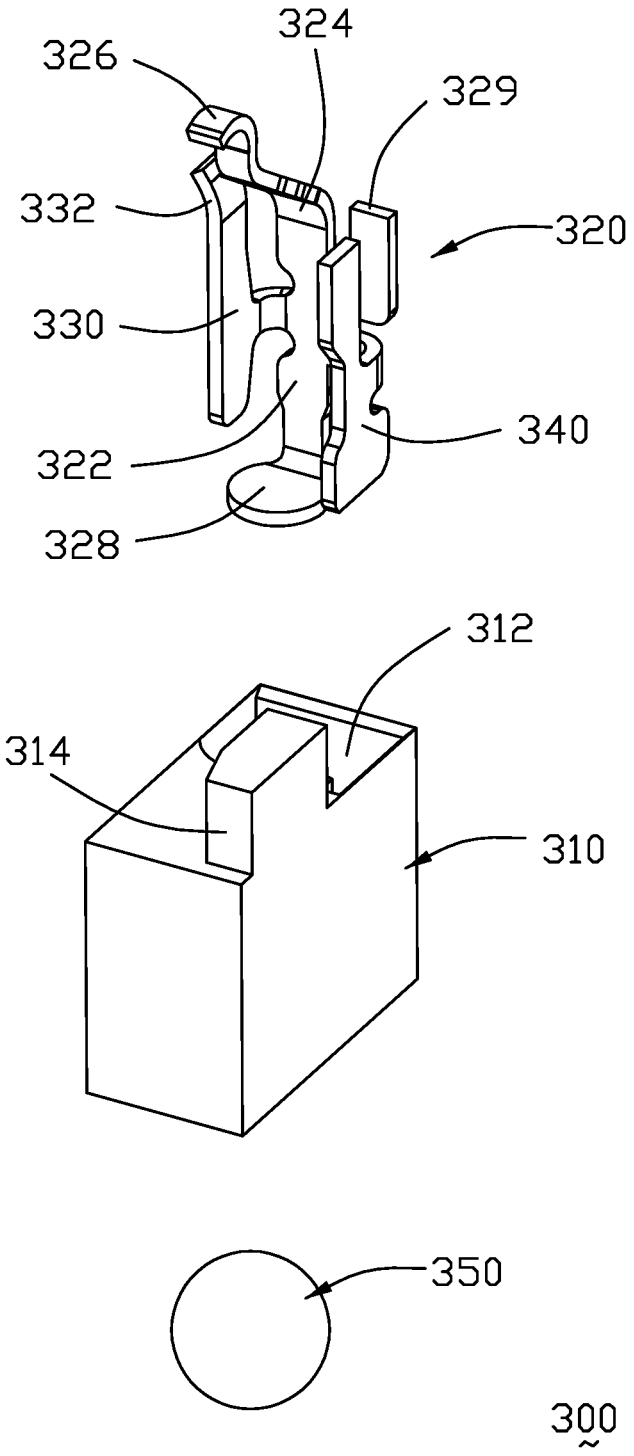
FIG. 5(A) is an exploded perspective view of the electrical connector of a third embodiment of the invention.
Figure 5B:
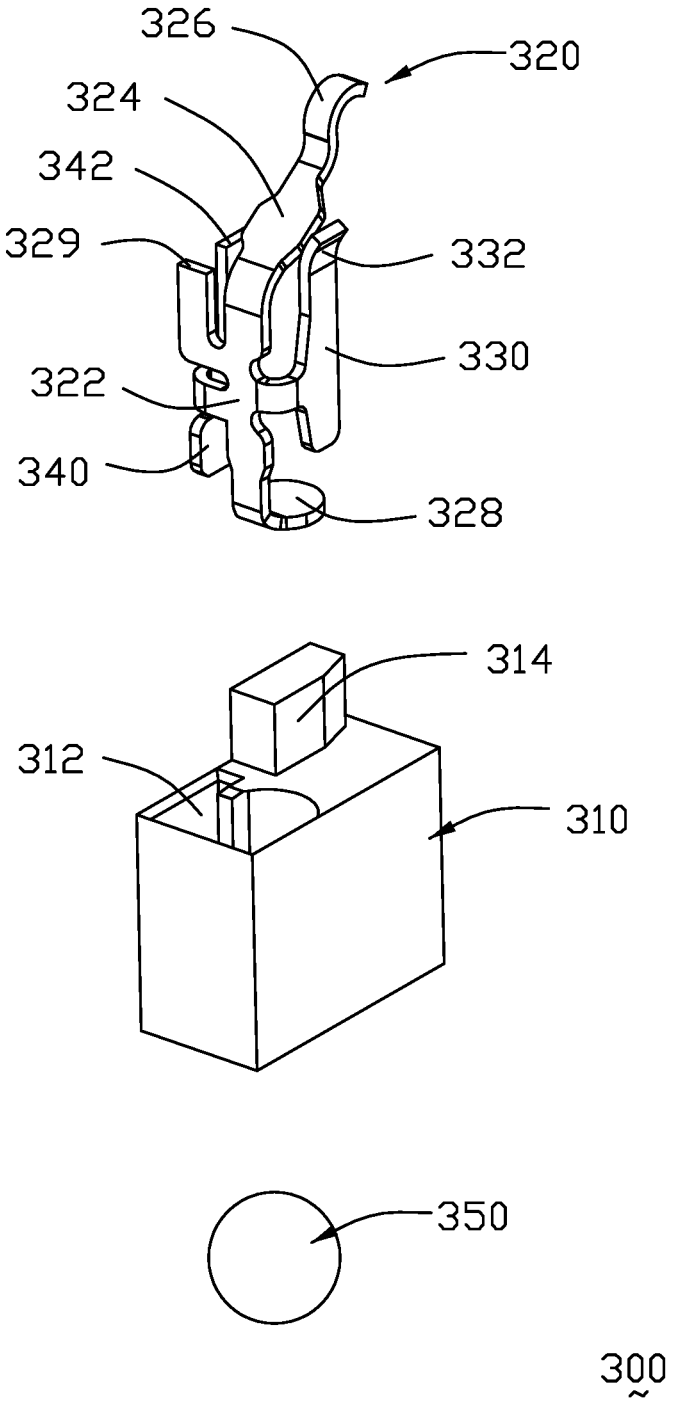
FIG. 5(B) is another exploded perspective view of the electrical connector of FIG. 5(A)
Figure 5C:
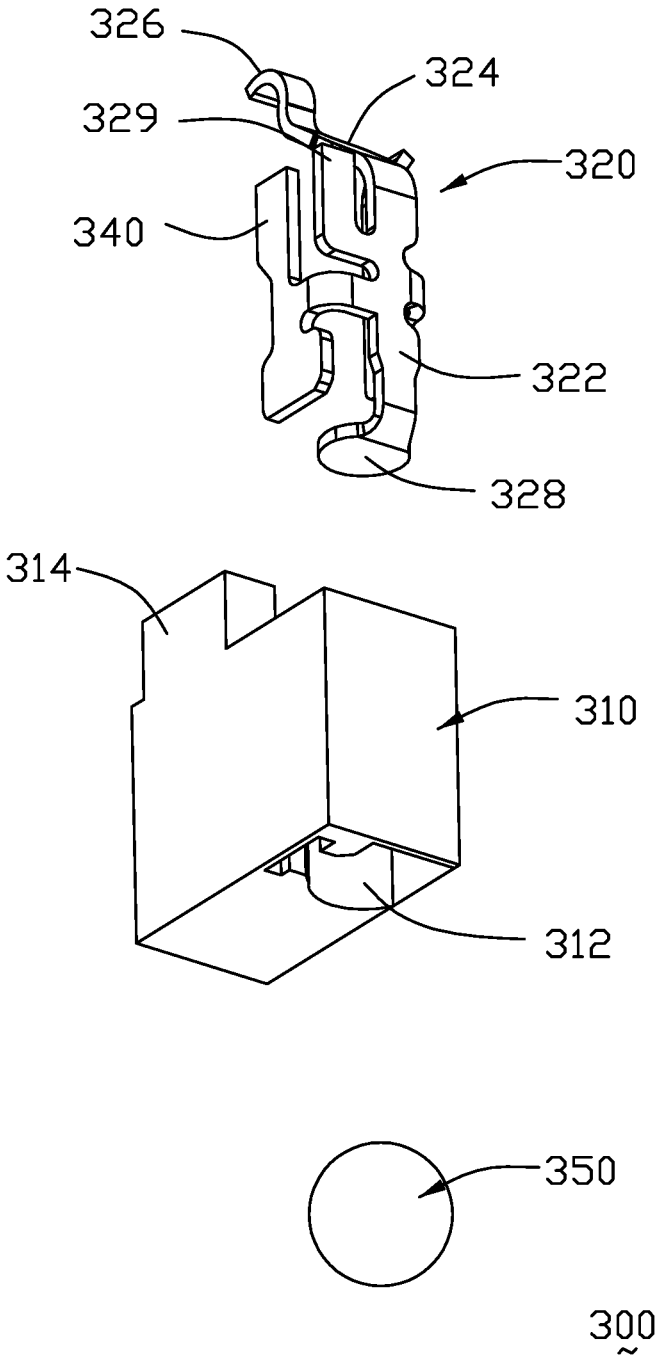
FIG. 5(C) is another exploded perspective view of the electrical connector of FIG. 5(A)

In a top view shown by FIG. 1(C), the supporting section 130 is angled with the base 122 via an acute angle while the retaining section 140 is angled with regard to the base 122 via a right angle. In a side view shown by FIG. 1(E), a transitional line of the curvilinear configuration of the abutting section 132 as indicated with A in FIG. 3(E), is not horizontal but extending forwardly and downwardly in inclined manner for compliance with the downwardly deflected contacting arm 124 during the mating process with the CPU. As shown in FIG. 2(D), the side edge of the supporting section 130 is not vertical but extending in an oblique direction. Understandably, because the curved abutting section 132 is adapted to be outwardly deflected, the downward deflection of the contacting arm 124 during mating become easy and smooth. In addition, because the supporting section 130 and the associated abutting section 132 are essentially angled with regard to the base 122 via an acute angle to comply with the tapered configuration of the contacting arm 124, the downward deflection of the contacting arm 124 during mating is relatively smooth. Moreover, the transitional line A (as shown and indicated in FIG. 3(E) and shown in FIG. 1(E)) which essentially extends transversely on the abutting section 132 is not horizontal but extending in a forwardly and downwardly inclined manner, the confrontation between the side edge of the contacting arm 124 and the abutting section 132, when the CPU and the connector are fully mated with each other, may be compliant without harshness. In brief, all the novel features of the instant invention mentioned above may avoid the defects inevitably owned by the connector disclosed in the aforementioned U.S. Pat. No. 6,019,611.

To comply with the angled supporting section 130, the passageway 112 forms an oblique section 116 so as to compliantly receive the angled supporting section 130 of the contact 120 therein. A plurality of standoffs 114 are formed on an upper surface of the housing 110 and aligned with the corresponding retaining sections 140 in the front-to-back direction for upwardly abutment with the CPU. In a top view as shown by FIG. 1(C), supporting section 130 and the standoff 114 are located by two sides of the contacting arm 124 in the transverse direction perpendicular to the front-to-back direction. Notably, the contacting arm 124 sidewardly contacts the curved section 132 while being space from the standoff 114. Understandably, the standoff 114 is used to not only upwardly support the CPU for preventing over-deflection of the contacting arm 124 but also sidewardly protect the contacting arm 124 to prevent improper sideward invasion of an external piece. The retaining section 140 is equipped with side edge barbed structure for engagement within the passageway 112.

Referring to FIGS. 3(A)-4(C) showing the second embodiment of this embodiment, the electrical connector 200 includes an insulative hosing 210 with a plurality of passageways 212 (only one shown) extending therethrough in the vertical direction. Each passageway 212 receives a contact 220 therein. Each contact 220 includes a base 222 with a resilient contacting arm 224 upwardly and obliquely extending from an upper end of the base 222 and equipped with a bulged contacting section 226 at a free end thereof. A retaining section 240 is sidewardly linked to a side edge of the base 222 with a connecting upper end 242 adapted to be originally connected to a contact carrier for downwardly assembling the contact 220 into the passageway 212. The side edge of the retaining section 240 forms a barbed structure for engagement with the housing 210 to retaining the contact 220 within the passageway 212.

A supporting section 230 is sidewardly linked to the other side edge of the base 222 with an outwardly and upwardly curved guiding and abutting head/section 232 at a free end thereof. Different from the first embodiment which discloses the solder pad 134 is solely formed on the supporting section 130, in the second embodiment as shown in FIGS. 3(A)-4(D), the solder pad structure for attachment of the solder ball 230 thereon includes a first half 234 formed on a lower end of the supporting section 230 and a second half 228 formed on a lower end of the base 222, therefore the contact 220 has dual electrical path shown as S2 and S3, one is from the resilient contacting arm 224 to the second half 228, and the other is from the abutting section 232 to the first half 234. Another difference compared with the first embodiment, is that in this second embodiment, the abutting section 232 is wider, along the front-to-back direction, than supporting section 230 so as to result in more contacting areas with the side edge of the contacting arm 224.

Similar to the first embodiment, in the second embodiment the housing 210 includes a plurality of standoffs 214 corresponding to the passageways 212, and each passageway 212 includes an oblique section 216 to comply with the angled supporting section 230. Understandably, the novel features and the operation way of the second embodiment are essentially same with those of the first embodiment without necessity of illustration again.

Referring to FIGS. 5(A)-7(B) showing the third embodiment, an electrical connector includes an insulative housing 310 with a plurality of passageways 312 extending therethrough in a vertical direction. A plurality of standoffs 314 are formed on the upper surface of the housing 310 corresponding to the passageways 312.

Figure 7A:
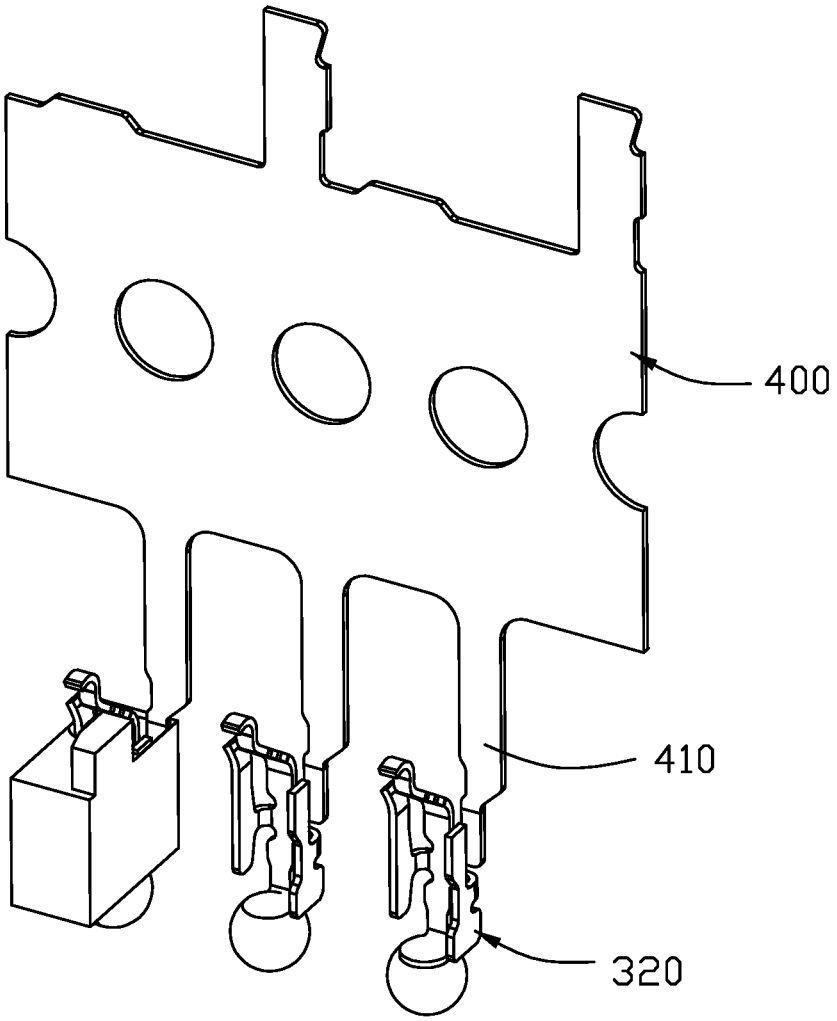
FIG. 7(A) is a perspective view of the contacts of the electrical connector of FIG. 5(A) wherein the contacts are linked with the contact carrier and one of the contacts is disposed in the passageway of the housing.
Figure 7B:
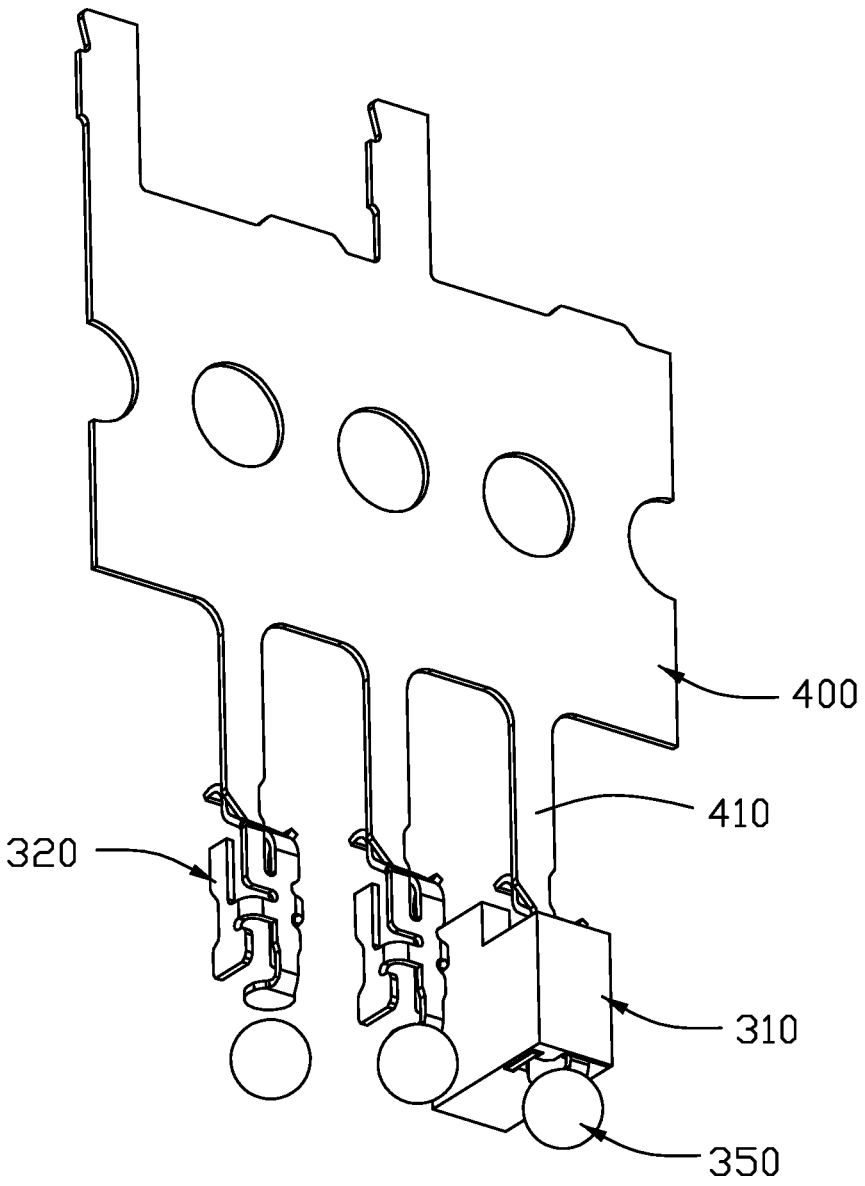
FIG. 7(B) is another perspective view of the contacts of the electrical connector of FIG. 7(A) wherein the contacts are linked with the contact carrier and one of the contacts is disposed in the passageway of the housing.
Figure 8:
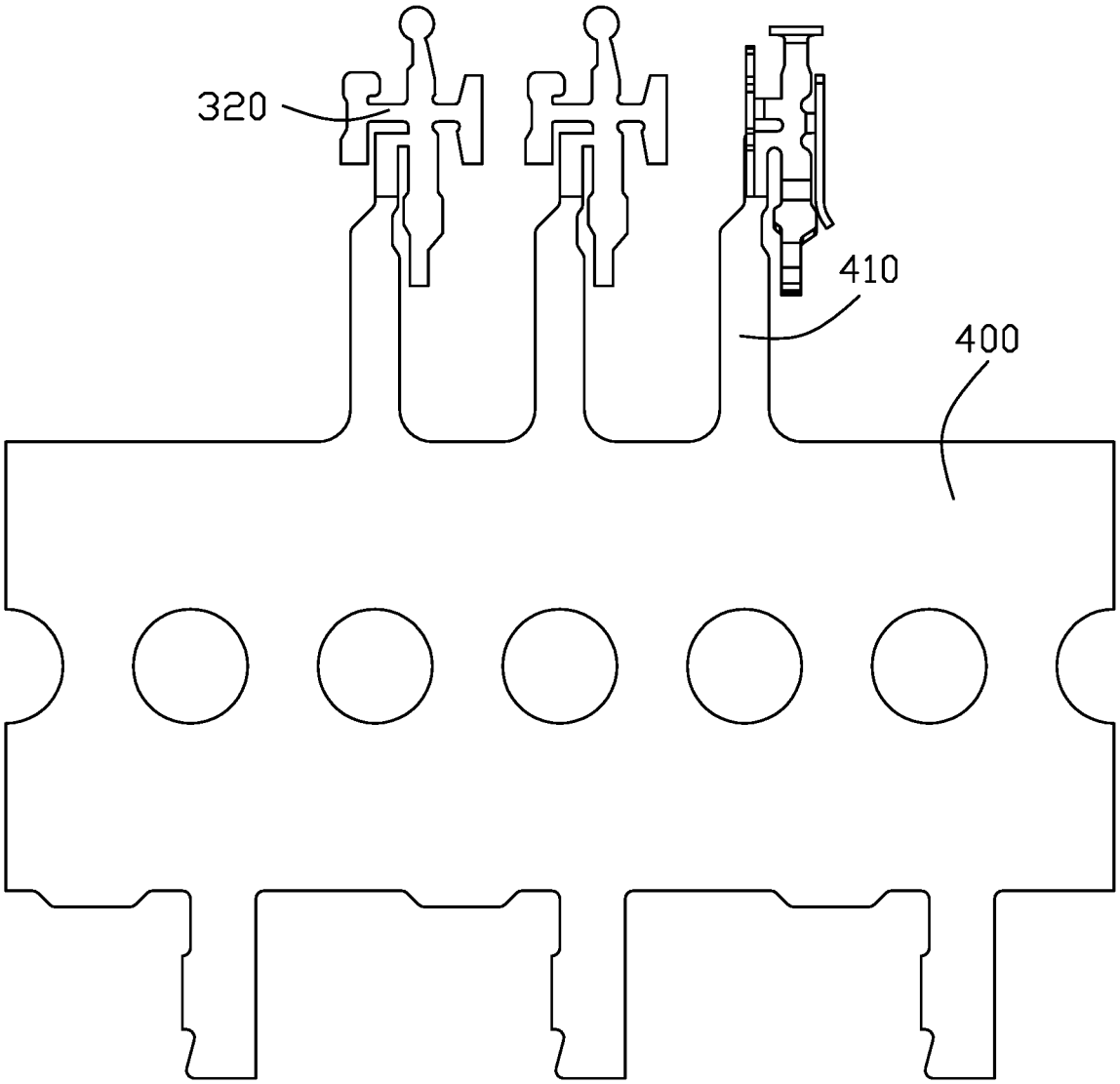
FIG. 8 is a perspective view of the contacts of the electrical connector of FIG. 5(A) wherein the contacts are linked with the contact carrier and one of the contacts is folded while others are unfolded.

Each passageway 312 receives a contact 320 therein. Each contact 320 includes a base 322, and a resilient contacting arm 324 upwardly and obliquely extending from an upper end of the base 322 and equipped with a bulged contacting section 326 at a free end of the resilient contacting arm 324. A retaining/vertical section 340 is sidewardly linked to a side edge of the base 322. Different from the first and second embodiments, in the third embodiment the connecting upper end 329 is formed on an upper portion of the base 322 rather than on the retaining section 340 and side by side spaced from the contacting arm 324 in the transverse direction perpendicular to the front-to-back direction along which the contacting arm 324 extends in a top view. As shown in FIGS. 7(A) and 7(B), the connecting upper end 329 is unitarily formed with and connected to a contact strip 410 of the contact carrier 400 before assembling into the housing 310. Different from the first embodiment and the second embodiment, the solder pad 328 is solely formed at a lower end of the base 322 for attachment of the solder ball 350 rather than being involved with the supporting section 330.

Figure 6A:
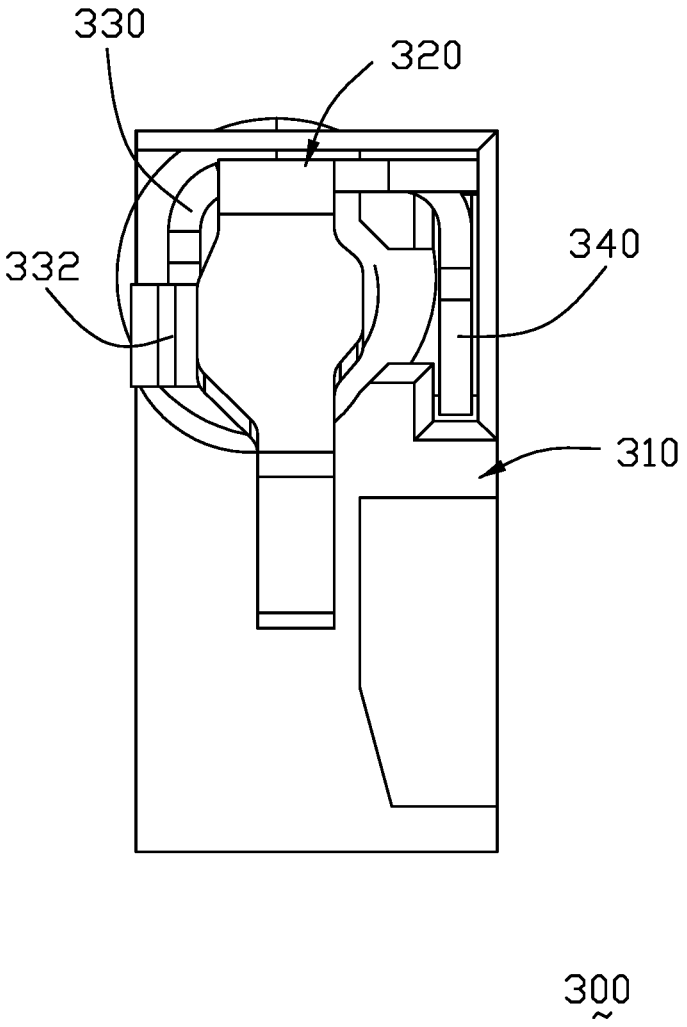
FIG. 6(A) is a top view of the electrical connector of FIG. 5(A)
Figure 6B:
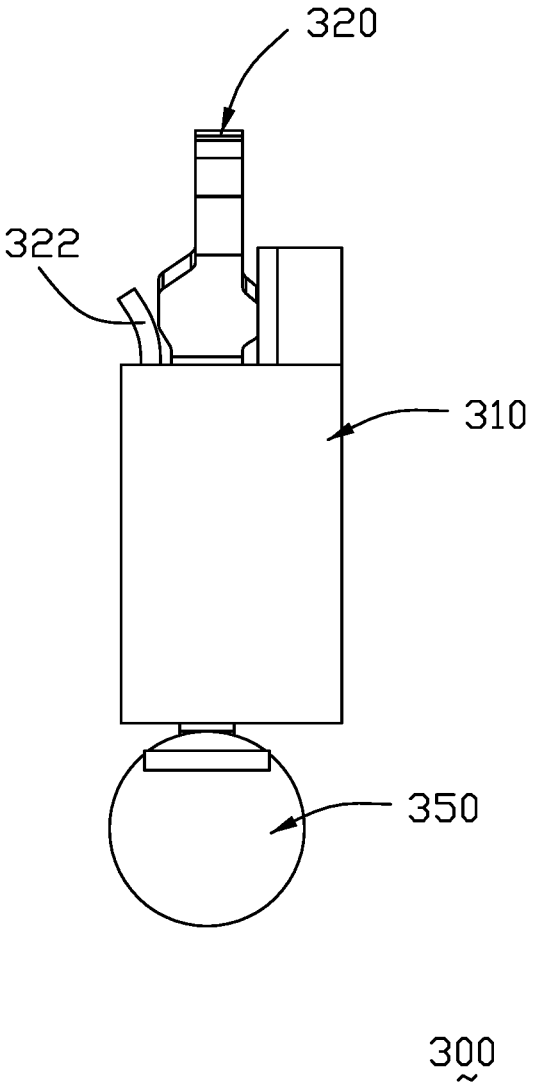
FIG. 6(B) is an elevational view of the electrical connector of FIG. 6(A) along the front-to-back direction.
Figure 6C:
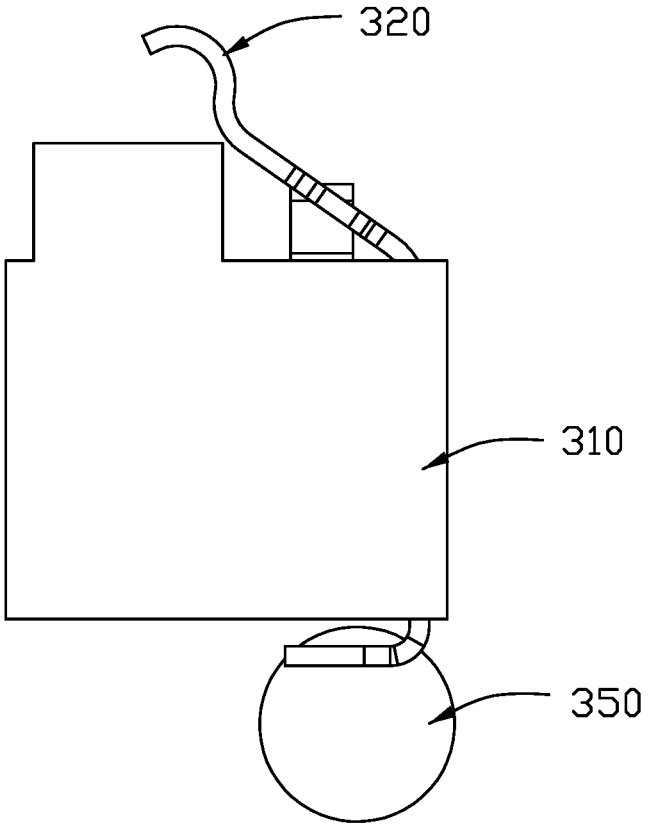
FIG. 6(C) is a side view of the electrical connector of FIG. 6(A)

The supporting section 330 is sidewardly linked to the other side edge of the base 233 with an upwardly and obliquely curved abutting section 322 at an upper end thereof. In the third embodiment, as shown in FIG. 6(A) both the retaining section 340 and the supporting section 330 are angled with regard to the base 322 via a right angle. Understandably, the novel features and the operation way of the connector disclosed in the third embodiment are similar to those disclosed in the first and second embodiments, thus requiring no detailed illustration. Understandably, the retaining section 340 may provide optimal capacitance to the whole contact.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector for mating with an electronic package, comprising:

an insulative housing defining a plurality of passageways extending therethrough in a vertical direction; and a plurality of contacts disposed in corresponding passageways, the contact having:

a base extending in a first vertical plane and a resilient contacting arm upwardly and obliquely extending from an upper end of the base, the resilient contacting arm having a bulged contacting section at a free end thereof;

a retaining section sidewardly linked to one side edge of the base to retain the contact within the passageway; and a supporting section sidewardly linked to another side edge of the base with an upwardly and obliquely curved abutting section at an upper end of the supporting section;

wherein the abutting section is adapted to be outwardly deflected when the contacting arm is downwardly deflected to sidewardly press the abutting section; and wherein in a top view along the vertical direction, the supporting section is angled with regard to the base via an acute angle.

2. The electrical connector as claimed in claim 1, wherein in the top view, the retaining section is angled with regard to the base via a right angle.

3. The electrical connector as claimed in claim 1, wherein a transverse transition line on the abutting section extends forwardly and downwardly in a side view for compliance with the downwardly deflected contacting arm during mating with the electronic package.

4. The electrical connector as claimed in claim 1, wherein a width of the abutting section is larger than that of the contacting arm.

5. The electrical connector as claimed in claim 1, wherein in the top view, the passageway forms an oblique section to comply with the supporting section.

6. The electrical connector as claimed in claim 1, wherein the insulative housing defines a standoff upon an upper surface thereof and corresponding to the passageway, and a height of the standoff is similar to that of the abutting section above the upper surface, the retaining section is hidden below the upper surface of the housing.

7. The electrical connector as claimed in claim 1, wherein the contact includes a connecting upper end for linking to a contact carrier to downwardly assemble the contact into the passageway.

8. The electrical connector as claimed in claim 7, wherein the connecting upper end is formed on the retaining section.

9. The electrical connector as claimed in claim 7, wherein the connecting upper end is formed on the base in a coplanar manner.

10. The electrical connector as claimed in claim 1, wherein the contact further includes a horizontal solder pad, the solder pad is formed on lower ends of both the base and the supporting section.

11. An electrical connector for mating with an electronic package, comprising:

an insulative housing having a plurality of passageways extending therethrough in a vertical direction; and a plurality of contacts disposed in corresponding passageway, the contact including:

a plate base, a resilient contacting arm upwardly and obliquely extending from an upper end of the plate base and having a contacting section, and a retaining section and a supporting section linking with opposite lateral sides of the plate base;

wherein the retaining section is retained in the passageway, the supporting section is located under the contacting arm in a top view in a vertical direction and has an arcuate abutting portion curving obliquely and outwardly to guide a downward movement of the contacting arm, and the abutting portion limits a further downward movement of the contacting arm.

12. The electrical connector as claimed in claim 11, wherein in the top view along the vertical direction, the supporting section is located separately from one lateral side of the contacting arm.

13. The electrical connector as claimed in claim 12, wherein the contacting arm comprises a slant portion continuing from the plate base, the contacting section bulges from the slant portion, the slant portion defines a widened portion abutting against the abutting section.

14. An electrical connector for mating with an electronic package, comprising:

an insulative housing defining a plurality of passageways extending therethrough in a vertical direction; and a plurality of contacts disposed in corresponding passageways, the contact having:

a base extending in a first vertical plane and a resilient contacting arm upwardly and obliquely extending from an upper end of the base, the resilient contacting arm having a bulged contacting section at a free end thereof;

a retaining section sidewardly linked to one side edge of the base to retain the contact within the passageway; and a supporting section sidewardly linked to another side edge of the base with an upwardly and obliquely curved abutting section at an upper end of the supporting section; wherein the abutting section is adapted to be outwardly deflected when the contacting arm is downwardly deflected to sidewardly press the abutting section; and the insulative housing defines a standoff upon an upper surface thereof and corresponding to the passageway, and a height of the standoff is similar to that of the abutting section above the upper surface, the retaining section is hidden below the upper surface of the housing.

15. The electrical connector as claimed in claim 14, wherein in the top view, the retaining section is angled with regard to the base via a right angle.

16. The electrical connector as claimed in claim 14, wherein a transverse transition line on the abutting section extends forwardly and downwardly in a side view for compliance with the downwardly deflected contacting arm during mating with the electronic package.

17. The electrical connector as claimed in claim 14, wherein a width of the abutting section is larger than that of the contacting arm.

18. The electrical connector as claimed in claim 14, wherein in the top view, the passageway forms an oblique section to comply with the supporting section.

19. The electrical connector as claimed in claim 14, wherein the retaining section of the contact has a connecting upper end for linking to a contact carrier to downwardly assemble the contact into the passageway.

20. The electrical connector as claimed in claim 14, wherein the contact further includes a horizontal solder pad, the solder pad is formed on lower ends of both the base and the supporting section.

* * * * *